US008555912B2

(12) United States Patent
Woolley et al.

(10) Patent No.: US 8,555,912 B2
(45) Date of Patent: Oct. 15, 2013

(54) DYNAMIC LEAK CONTROL FOR SYSTEM WITH WORKING FLUID

(75) Inventors: Lance D. Woolley, Glastonbury, CT (US); Sean P. Breen, Holyoke, MA (US)

(73) Assignee: United Technologies Corporation, Hartford, CT (US)

( * ) Notice: Subject to any disclaimer, the term of this patent is extended or adjusted under 35 U.S.C. 154(b) by 467 days.

(21) Appl. No.: 12/810,239

(22) PCT Filed: Dec. 28, 2007

(86) PCT No.: PCT/US2007/089041

§ 371 (c)(1),
(2), (4) Date: Sep. 14, 2010

(87) PCT Pub. No.: WO2009/085048

PCT Pub. Date: Jul. 9, 2009

(65) Prior Publication Data

US 2011/0000552 A1 Jan. 6, 2011

(51) Int. Cl.
*F15D 1/00* (2006.01)

(52) U.S. Cl.
USPC ..... 137/13; 137/485

(58) Field of Classification Search
USPC ..... 137/13, 485
See application file for complete search history.

(56) References Cited

U.S. PATENT DOCUMENTS

| | | | | |
|---|---|---|---|---|
| 4,785,639 | A * | 11/1988 | Biagini | 62/132 |
| 5,483,797 | A * | 1/1996 | Rigal et al. | 60/641.2 |
| 5,560,210 | A * | 10/1996 | Bronicki | 60/648 |
| 6,035,643 | A | 3/2000 | Rosenblatt | |
| 6,167,706 | B1 | 1/2001 | Bronicki et al. | |
| 6,523,347 | B1 | 2/2003 | Jirnov et al. | |
| 7,174,716 | B2 | 2/2007 | Brasz et al. | |
| 7,188,001 | B2 | 3/2007 | Young et al. | |
| 7,290,393 | B2 | 11/2007 | Cogswell et al. | |

FOREIGN PATENT DOCUMENTS

JP 60206912 A 10/1985

OTHER PUBLICATIONS

International Search Report and Written Opinion mailed Sep. 23, 2008 (9 pgs.).
International Preliminary Report on Patentability mailed Jul. 8, 2010 (5 pgs.).

* cited by examiner

*Primary Examiner* — Kenneth Bomberg
*Assistant Examiner* — Shafiq Mian
(74) *Attorney, Agent, or Firm* — Carlson, Gaskey & Olds, PC

(57) ABSTRACT

An organic rankine cycle system includes a sensor for sensing a condition indicative of pressure within the system and a control which responsively provides heat to said system when the pressure within the system is sensed to be at a predetermined threshold, near ambient pressure, during periods in which the system is shut down or preparing to operate. Provision is also made to remove the heat from the system when the pressure therein rises to a predetermined higher pressure threshold.

10 Claims, 2 Drawing Sheets

DYNAMIC LEAK CONTROL FOR SYSTEM WITH WORKING FLUID

TECHNICAL FIELD

This disclosure relates generally to closed loop systems with a pressurized working fluid, and, more particularly, to a method and apparatus for preventing the migration of contaminant gases into the system during shut down.

BACKGROUND OF THE DISCLOSURE

Closed loop systems often contain a working fluid with properties specific to the successful or efficient operation of the equipment. The working fluid properties may be degraded by the addition of foreign, particles. Closed, loop systems generally operate at elevated pressures relative to ambient pressure. This ensures that leaks propagate out of the system during operation. During system shutdown, this scenario may be reversed with the closed loop system pressure at or below ambient pressure. As a result, molecules such as oxygen and nitrogen may migrate into the system. These pollute the working fluid and negatively, impact the subsequent operation and efficiency of the system. Currently, related systems require a purge device that extracts the system pollutants from the working fluid.

One such closed loop system is that of an organic rankine cycle system which includes in serial flow relationship, an evaporator or boiler, a turbine, a condenser and a pump. Such a system is shown and described in U.S. Pat. No. 7,174,716, assigned to the predecessor of the assignee of the present invention.

DISCLOSURE

In accordance with one aspect of the disclosure, a heat source is operatively connected to the evaporator and has a control which is responsive to a condition sensor for maintaining the pressure in the system above a predetermined threshold.

In accordance with another aspect of the disclosure, a process of preventing migration of impurities into a closed loop system during shut down includes the steps of sensing the pressure in the system and responsively operating a heat source so as to maintain the pressure in the system above a predetermined threshold.

In the drawings as hereinafter described, a preferred embodiment is depicted; however, various other modifications and alternate constructions can be made thereto without departing from the spirit and scope of the disclosure.

DETAILED DESCRIPTION OF THE DISCLOSURE

Figure 1:
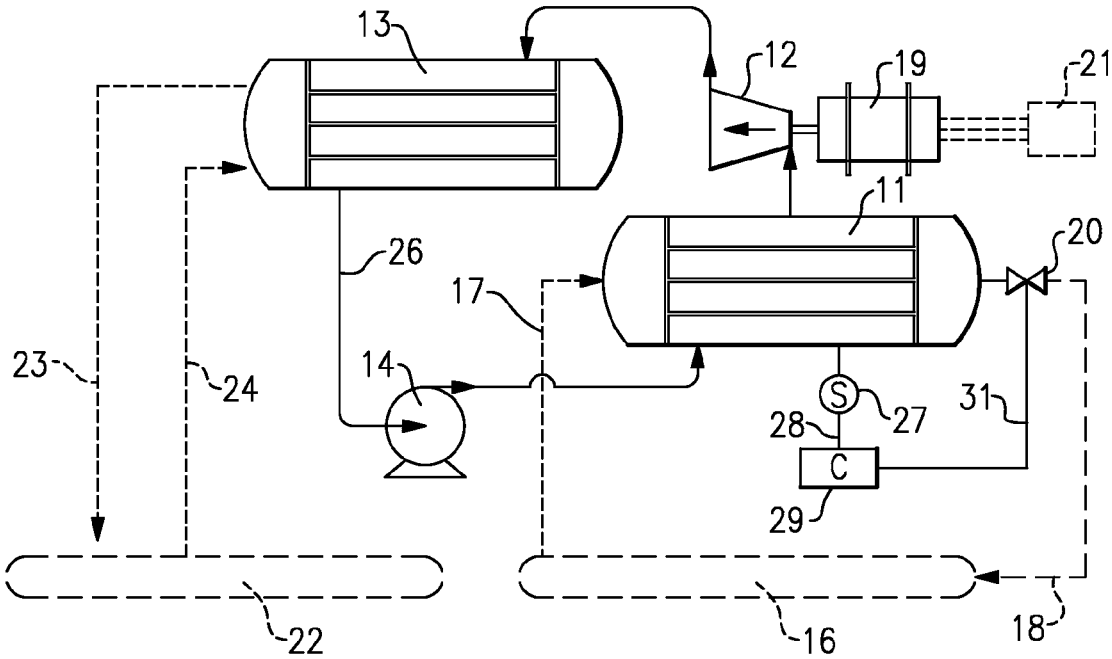
FIG. 1 is a schematic illustration of an organic-rankine cycle system with the present invention incorporated therein.

Shown in FIG. 1 is an organic ranking cycle system which includes, in serial working-fluid-flow relationship, an evaporator 11, a turbine 12, a condenser 13 and a pump 14. The working fluid flowing therethrough can be of any suitable refrigerant such as refrigerant R-245fa, R134, pentane, for example.

The energy which is provided to drive the system is from of a primary heat source 16 by way of a closed loop which connects to the evaporator 11 by way of lines 17 and 18. A valve 20 is provided to turn this flow on or off and may be located either upstream or downstream from the heat exchanger 16. The primary heat source 16 may be of various types such as, for example a geothermal source, wherein naturally occurring hot fluids are available below the surface of the earth. The temperatures of such geothermal sources are generally greater than 150-F, sufficient to operate most working fluids well above atmospheric pressure.

After the working fluid is heated in the evaporator 11, it passes as a high temperature, high pressure vapor to the turbine 12 where the energy is converted to motive power. The turbine 12 is drivingly attached to a generator 19 for generating electrical power that then passes to the grid 21 for further distribution.

After passing to the turbine 12, the working fluid, which is now a vapor which is at a reduced temperature and pressure vapor, passes to the condenser 13, which is fluidly connected to a cooling water source 22 by lines 23 and 24. The condenser 13 functions to condense the working fluid vapor into a liquid, which then flows along line 26 to the pump 14, which then pumps the liquid working fluid back to the evaporator 11 by way of line 27.

During normal operation of the above described organic rankine cycle system, because of the energy added by the primary heat source 16, the working fluid always remains at a pressure substantially greater than ambient pressure. However, during selected periods of time, such as during oil warm up or when the system is shut down, such as, for example, during periods of maintenance and/or repair, then the working fluid therein slowly cools and eventually may reach ambient temperature. At this point, because of the thermodynamic, properties of the working fluid that relates temperature and pressure of a saturated system, the pressure within the system will tend to further decrease to a level below ambient pressure. This low pressure condition will then allow the migration of contaminating gases, such as oxygen and/or nitrogen, to migrate into the system from the atmosphere. The present disclosure is intended to prevent such a migration from occurring.

In one form of the disclosure, a sensor 27 is provided to sense a condition indicative of pressure in the system, such as the temperature or pressure within the evaporator 11, and to send a responsive signal along line 28 to a control 29. Control 29 is connected by a line 31 to a valve 20 with the valve 20 then being operated by the control 29 in response to the sensed temperature/pressure in such a manner as to maintain the temperature/pressure in the evaporator 11 at a level which will remain above the ambient pressure/temperature in the evaporator 11 at a level which will remain above the ambient pressure/temperature and therefore prevent the migration of unwanted gases into the system during periods of shut down.

Figure 2:
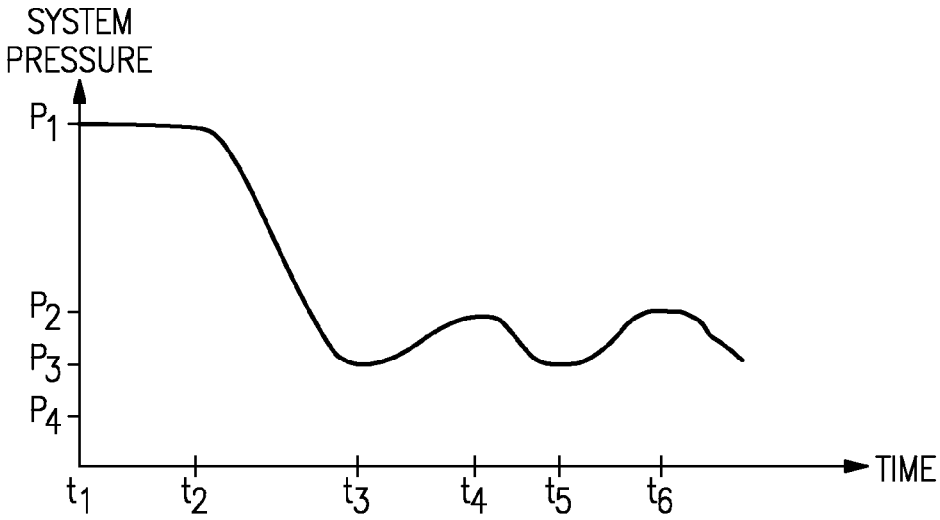
FIG. 2, is a graphical illustration of the manner in which the pressure is controlled in accordance with the present invention.

Referring now to FIG. 2, the pressure within the system is shown as a function of time in which the system is operating normally and then is shutdown, with the present invention then operating to prevent migration of the gases into the system.

As will be seen, at time $t_1$ the system is operating normally such that the pressure is at $P_1$. Further, at time $t_2$, the system is shut down and the pressure begins to decline, and at time $t_3$, reaches a threshold level of $P_3$, which is lightly above the anticipated ambient pressure $P_4$ for the environment of the warming system. When this threshold pressure is reached, the sensor 27 signals the control 29 which then opens the valve 32 to provide heat to the evaporator 11 to thereby cause the pressure in the system to be gradually increased.

At time $t_4$, a second threshold of pressure equals $P_2$ and the control 20 then responsively moves, the valve 32 to a fully closed or at least a partially closed position. The pressure of the system is then gradually reduced such that at time $t_5$ it again reaches the lower threshold of $P_3$ wherein the control 29 again opens the valve 32 to add heat to the system. At time $t_6$, the control again moves the valve 32 to a more-closed position. This cycle is repeated so as to maintain the system at a pressure above that of ambient so that migration of gases into the system is prevented during shut down. When normal operation resumes, the control 29 remains in an inactive condition until called on to be activated by the sensor 27 when, for example, the system is again shutdown.

Figure 3:
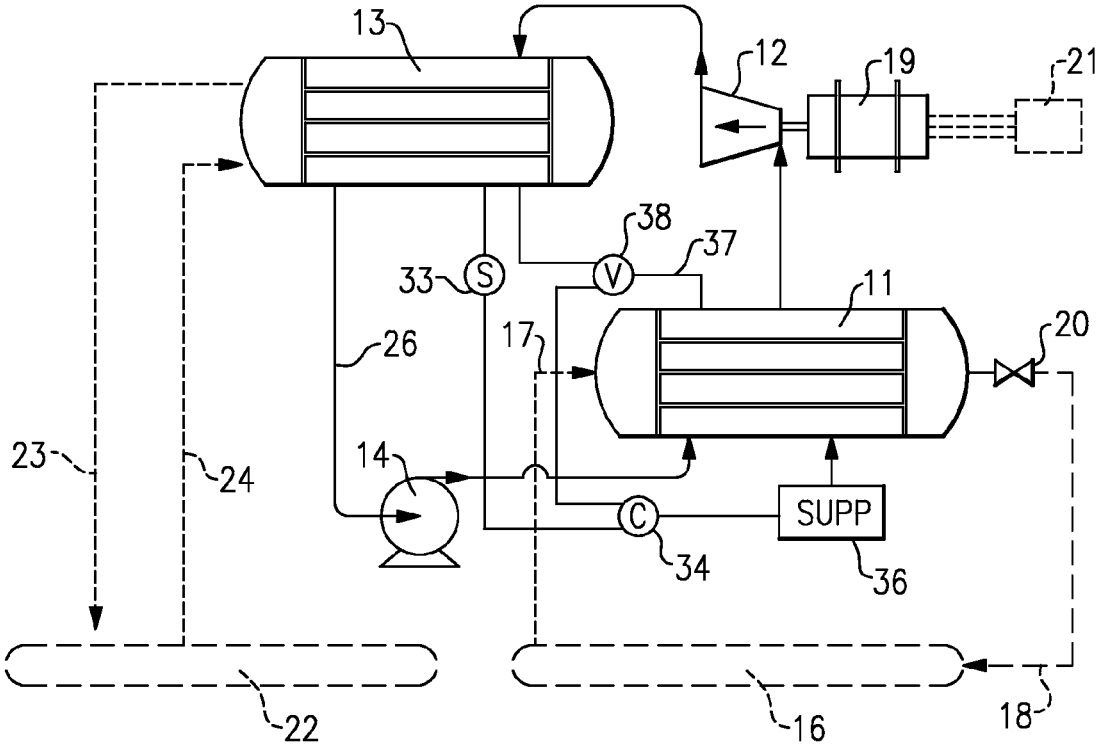
FIG. 3 is a schematic illustration of an organic rankine cycle system with a modified embodiment of the present invention incorporated therein.

An alternative embodiment is shown in FIG. 3 wherein a sensor 33 senses the pressure within the condenser 13 rather than within the evaporator 11. In this regard, it is recognized that during the period following shut down, the pressures in the evaporator 11 and in the condenser 13 tend toward equalization since they are only separated on one side by the pump 14 which provides nearly complete restriction between the two, and on the other side by the turbine 12 which provides only a partial restriction between the two tanks.

Another alternative is to use a supplementary heat source 36 rather than the primary heat source 16 during periods of shut down. Such a supplementary heat source might be steam or hot water from a source other than the primary heat source 16, or it may be by way of an electrical resistance heater. Similar to the FIG. 1 embodiment, the sensor 33 sends a signal to the control 34 which then responsively operates the supplementary heat source 36 to maintain the pressure in the system above the ambient pressure during shut down.

As another alternative, to ensure that the two tanks i.e. the evaporator 11 and the condenser 13, are maintained at substantially the same pressure during pressure shut down, the two may be selectively fluidly interconnected by way of a line 37 and valve 38, with the valve 38 being controlled by way of the control 34.

While the present invention has been particularly shown and described with reference to preferred and modified embodiments as illustrated in the drawings, it will be understood by one skilled in the art that various changes in detail may be made thereto without departing from the spirit and scope of the disclosure as defined by the claims.

We claim:

1. A method of preventing migration of gases into a closed loop organic rankine cycle system during selected periods of time comprising the steps of:

establishing a threshold pressure to be maintained in the closed loop organic rankine cycle system in order to prevent migration of gases therein when the closed loop organic rankine cycle system is in a shutdown condition;

using a sensor, and sensing a characteristic indicative of the pressure within the closed loop organic rankine cycle system during the shutdown condition;

comparing the established threshold pressure with the sensed characteristic indicative of the pressure within the closed loop organic rankine cycle system during the shutdown condition; and providing heat to said closed loop organic rankine cycle system to cause the pressure therein to rise above the threshold pressure when the pressure within the closed loop organic rankine cycle system is at or below the threshold pressure so as to prevent migration of gases into the closed loop organic rankine cycle system.

2. A method as set forth in claim 1, wherein said sensor is a pressure sensor.

3. A method as set forth in claim 1, wherein the condition sensed is in the evaporator of the closed loop organic rankine cycle system.

4. A method as set forth in claim 1, wherein said established threshold is above the anticipated external or ambient pressure relative to the closed loop organic rankine cycle system.

5. A method as set forth in claim 4, wherein said threshold pressure is slightly above the anticipated external or ambient pressure relative to the closed loop organic rankine cycle system.

6. A method as set forth in claim 1, wherein the step of providing heat is by way of a primary heat source, which is a heat source used during normal operation of the closed loop organic rankine cycle system.

7. A method as set forth in claim 1, wherein the step of providing heat to the system is by way of a secondary heat source, which is separate from the heat source used in the normal operation of the closed loop organic rankine cycle system.

8. A method as set forth in claim 1, and including the further steps of: establishing a second higher threshold pressure; and when the sensed pressure in the system reaches said second higher threshold, removing heat from the closed loop organic rankine cycle system.

9. A method as set forth in claim 1, wherein the condition sensed is in a condenser.

10. A method as set forth in claim 1, and including the further step of fluidly interconnecting an evaporator and a condenser of the closed loop organic rankine cycle system when said threshold pressure is sensed.

* * * * *